US010449679B2

(12) United States Patent
Herrmann

(10) Patent No.: US 10,449,679 B2
(45) Date of Patent: Oct. 22, 2019

(54) HAND-OPERATED RATCHET CUTTER

(71) Applicant: KNIPEX—Werk C. Gustav Putsch KG, Wuppertal (DE)

(72) Inventor: Bernd Herrmann, Wuppertal (DE)

(73) Assignee: KNIPEX—Werk C. Gustav Putsch KG, Wuppertal (DE)

( * ) Notice: Subject to any disclaimer, the term of this patent is extended or adjusted under 35 U.S.C. 154(b) by 0 days.

(21) Appl. No.: 15/894,065

(22) Filed: Feb. 12, 2018

(65) Prior Publication Data

US 2018/0229382 A1 Aug. 16, 2018

(30) Foreign Application Priority Data

Feb. 13, 2017 (DE) ..... 10 2017 102 799

(51) Int. Cl.
*B26B 13/26* (2006.01)
*B26B 13/06* (2006.01)
*B26B 13/28* (2006.01)

(52) U.S. Cl.
CPC ..... *B26B 13/26* (2013.01); *B26B 13/06* (2013.01); *B26B 13/28* (2013.01)

(58) Field of Classification Search
CPC ..... B26B 13/26; B26B 13/06; B26B 13/28
See application file for complete search history.

(56) References Cited

U.S. PATENT DOCUMENTS 4,221,048 A * 9/1980 Parramore ..... B23D 29/00 30/135
4,312,127 A * 1/1982 Tanaka ..... B23D 21/10 30/250
4,378,636 A * 4/1983 Wick ..... B23D 23/00 30/250
4,899,445 A * 2/1990 Erbrick ..... B23D 29/023 30/251
5,218,768 A 6/1993 Putsch et al.
5,590,470 A 1/1997 Erbrick et al.

FOREIGN PATENT DOCUMENTS

EP 0 468 196 B1 10/1995

* cited by examiner

*Primary Examiner* — Omar Flores Sanchez
(74) *Attorney, Agent, or Firm* — Collard & Roe, P.C.

(57) ABSTRACT

A hand-operated ratchet cutter with a movable and a fixed handle, wherein the fixed handle forms a first fixed blade, and a movable blade is hinged to an upper end area of the fixed blade, for shearing interaction in a cutting plane with the fixed blade. The movable blade moves in a plane parallel to the cutting plane, and the fixed blade has a first flat side. A fixed jaw with a second flat side (21) facing the first flat side is formed that also extends up to the upper end area of the fixed blade. A passage slot for the movable blade adjusted to the thickness (d) is formed between the first and second flat side, so as to ensure the shearing interaction between the movable and fixed blade even under a load by having the jaw act as a supporting jaw.

4 Claims, 5 Drawing Sheets

HAND-OPERATED RATCHET CUTTER

CROSS REFERENCE TO RELATED APPLICATIONS

Applicant claims priority under 35 U.S.C. § 119 of German Application No. 10 2017 102 799.8 filed on Feb. 13, 2017, the disclosure of which is incorporated by reference.

AREA OF TECHNOLOGY

The invention relates to a hand-operated ratchet cutter, in particular to a cable cutter, with a movable and a fixed handle, wherein the fixed handle forms a first fixed blade, and a movable blade designed with a constant thickness in its direction of movement is hinged to an upper end area of the fixed blade, for shearing interaction in a cutting plane with the fixed blade, wherein further the movable blade moves in a plane parallel to the cutting plane, and the fixed blade facing the movable blade has a first flat side, wherein further a fixed jaw with a second flat side facing the first flat side is formed that also extends up to the upper end area of the fixed blade opposite to the fixed blade relative to the cutting plane.

PRIOR ART

Hand-operated ratchet cutters of the kind in question are known. For example, reference is here made to EP 0 468 196 B1. Such a ratchet cutter can have a ratchet mechanism with a locking lever and a feed lever, which engages into a tooth system formed on the outer periphery of the movable blade. This allows a ratchet-like displacement of the movable blade relative to the fixed blade. To this end, the movable blade can preferably be moved around a pivot bearing, in particular at an upper end area of the fixed blade.

Further known from U.S. Pat. No. 5,590,470 is a ratchet cutter of the kind in question, in which a fixed jaw opposite the fixed blade extends from the fixed handle until into the upper end area.

SUMMARY OF THE INVENTION

As regards the prior art described above, one object would be to give the ratchet cutter of the kind in question a more functionally reliable design.

In one possible solution to this object for a ratchet cutter according to a first inventive idea, the aim is to form a passage slot for the movable blade adjusted to the thickness between the first and second flat side, so as to ensure the shearing interaction between the movable and fixed blade even under a load by having the jaw act as a supporting jaw.

As a result of the proposed configuration, the arrangement of the fixed jaw not only enables a stabilization in the region of the pivot bearing formed in the upper end area, but also provides a support for the movable blade in the direction of extension of the geometric pivot axis. Such a support can further improve the shearing result under a load.

A passage slot for the movable blade arises between the first and second flat sides of the fixed blade and supporting jaw, wherein the passage slot as viewed in the direction of extension of the geometric pivot axis is adjusted to the thickness of the movable blade as viewed in the same direction relative to the distance between the first and second flat sides. The clearance between the first and second flat side can thus measure 1.01 to 1.1 times, and further potentially up to 1.2 or 1.3 times, the thickness of the movable blade as viewed in the same direction, for example. In addition, the selected clearance between the first and second flat side in the tenth of a millimeter range can be larger than the thickness of the movable blade as viewed in the same direction.

Additional features of the invention are explained below, to include the description of the figures, often in their preferred allocation to the subject matter of claim 1 or to features of additional claims. However, they can also be important as allocated to only individual features of claim 1 or the respective other claim, or each independently.

In a preferred embodiment, only three parts lying one over the other perpendicular to the rotational direction of the movable blade can be provided in the area of the passage slot, including the movable blade, as viewed in the thickness direction of the movable blade. Only the fixed blade, movable blade and jaw designed as a supporting jaw preferably extend into the area of the passage slot.

In a further embodiment, given a perpendicular projection toward a pivot axis of the movable blade, flat sections of the first and second flat sides located one over the other and, with the movable blade passing completely through the passage slot in the mentioned projection coming to overlap the movable blade, can initially decrease given a decreasing radius dimension of the movable blade. In this way, an overlapping surface that tapers like a crescent in the rotational direction of the movable blade can arise relative to the projected overlapping of the flat sides of the fixed blade and supporting jaw, and subsequently pass through a minimum relative to the radius dimension of the overlap in the rotational direction of the movable blade in a potential embodiment, so as to in this regard reach a radial expansion of the overlapping surface relative to the minimum described above in the pivot axis area, further in particular in the upper end area of the fixed blade and supporting jaw.

In particular, the embodiment described above can be realized by having a support shoulder for the material to be cut, e.g., cables, which is directed opposite the rotational direction of the movable blade during the cutting process, and borders the supporting jaw radially inwardly as viewed in the direction of extension of the pivot axis, be arranged downstream as viewed in the rotational cutting direction of the movable blade relative to the cutting edge of the fixed blade facing in the same direction in this view.

In another embodiment, the thickness of the supporting jaw as viewed in the direction of the rotational axis of the movable blade can in the area of the passage slot be 1 to 2 times the thickness of the fixed blade in the area of the passage slot and/or 1 to 2 times the thickness of the movable blade, which enables an overall stable configuration of the ratchet cutter that is simultaneously slender in the area of the passage slot.

In terms of disclosure, the areas or value ranges or multiple ranges indicated above and below also include all intermediate values, in particular in 1/10 increments of the respective dimension, i.e., potentially also dimensionless. For example, the indication 1 to 2 times also contains the disclosure 1.1 to 2 times, 1 to 1.9 times, 1.1 to 1.9 times, etc. This disclosure can serve to downwardly and/or upwardly limit a mentioned boundary on the one hand, but alternatively or additionally also to disclose one or several singular values from a respectively indicated range.

BRIEF DESCRIPTION OF THE DRAWINGS

The invention is explained below based on the attached drawing, which only represents an exemplary embodiment. The drawing shows.

DESCRIPTION OF THE EMBODIMENTS

Figure 1:
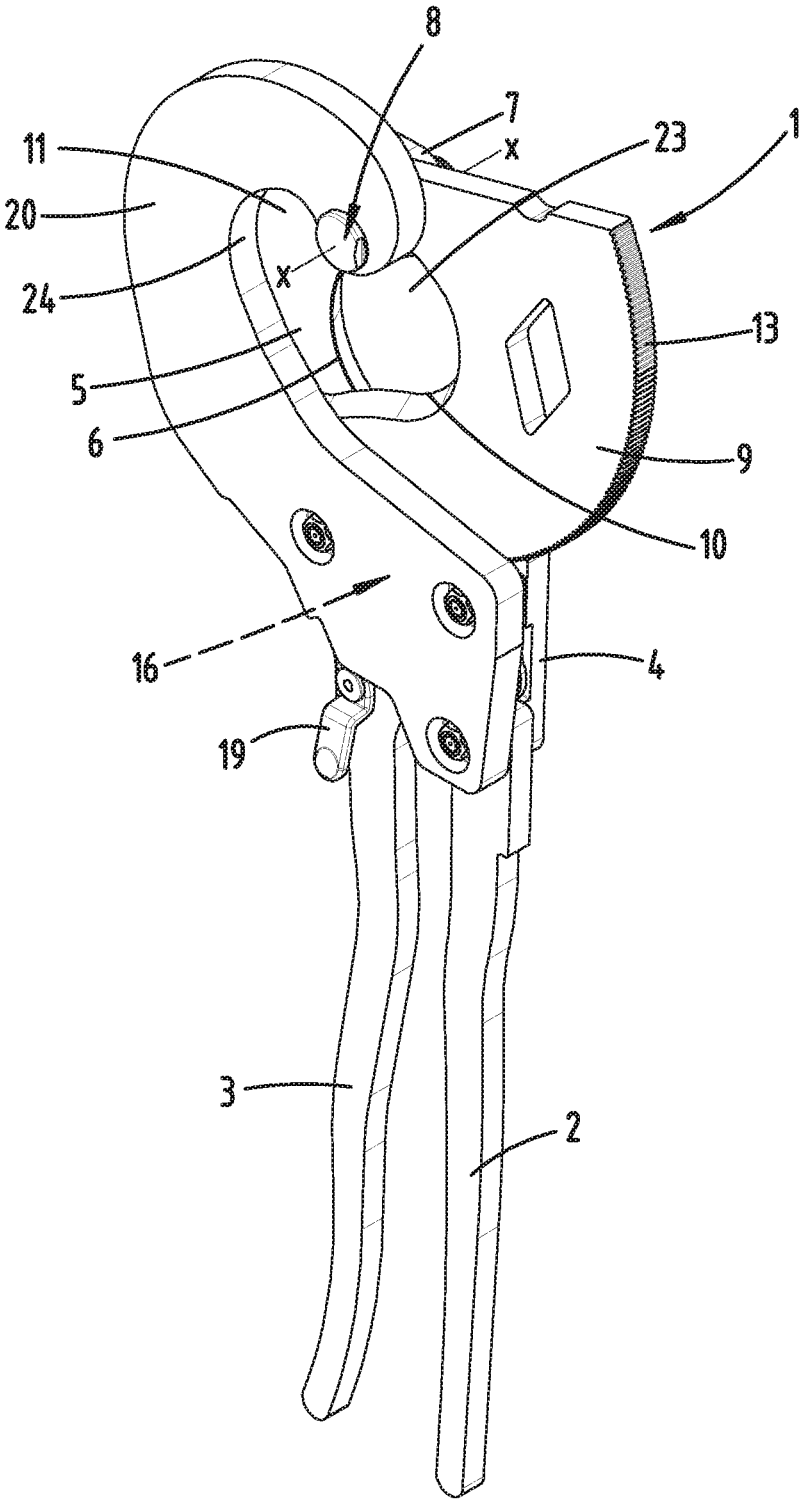
FIG. 1 A perspective view of a ratchet cutter of the kind in question.

Illustrated and described initially with respect to FIG. 1 is a hand-operated ratchet cutter 1 in the form of a cable cutter. The latter has two handles, specifically first a fixed handle 2 and a movable handle 3.

The fixed handle 2 forms a bearing plate 4, proceeding from which a fixed blade 5 is shaped like an arc with a concavely running cutting edge 6.

The upper end area 7 of the fixed blade 5 forms a pivot bearing 8 with a geometric pivot axis x for mounting a movable blade 9 shaped like a circular section with a cutting edge 10.

The movable blade 9 is movable in a parallel plane to the fixed blade 5, wherein the facing flat sides 11 of the fixed blade 5 and the flat side of the movable blade 9 glide along each other during a cutting process. A cutting plane E aligned transverse to the pivot axis x here arises.

The cutting edge 10 of the movable blade 9 proceeds from the pivot axis 8 and runs along an arc, highly concave, transitioning into a slightly convex area and finally into another less strongly concave area until into a free end area 12. The outer periphery of the movable blade 9 is equipped with a tooth system 13 or designed as a tooth segment.

A ratchet mechanism having a feed lever 14 and a locking lever 15 engages into the tooth system 13.

Reference is made to the EP 0 468 196 B1 mentioned at the outset with regard to the further structural design and function of the ratchet mechanism. The content of this patent specification is hereby completely included in the disclosure of the present invention, also for purposes of including features of this patent specification in claims of the present invention.

The movable handle 3 is mounted on a trunnion pin 17 in the area of the bearing plate 4. A spiral spring 18 arranged between the movable handle 3 and fixed handle 2 always tries to push the handles into the open position, in which both handles are spread apart.

The feed lever 14, locking lever 15, along with additional functional parts of the ratchet mechanism 16 along with a latching lever 19 and the movable blade 9 are in a shared plane, all preferably have the same thickness and are covered by a fixed jaw 20 in the form of a supporting jaw. This yields a very flat sandwich construction essentially comprised of three planes. The first plane forms the bearing plate 4 with the fixed blade extending from it. The second plane consists of the aforementioned equally thick individual parts, in particular the ratchet mechanism 16 and movable blade 9.

Finally, the third plane forms the fixed jaw 20. In an elevation view according to FIG. 2, which illustrates the pivot axis x with points, an overall arc-shaped extension proceeding from the connecting region on the bearing plate 4 arises relative to the fixed jaw 20, and runs all the way into the area of the pivot axis x, in whose upper end area the fixed jaw 20 and fixed blade 5 form the pivot bearing 8. A pin 21 that pivotably holds the movable blade 9 is thereby preferably retained in the respective upper end area of the fixed blade 5 as well as the fixed jaw 20. This yields a stable pivot bearing formation.

The flat side 21 of the fixed jaw 20 facing toward the movable blade 9 is runs parallel to the cutting plane E, and during the pivoting displacement of the movable blade 9 abuts against the facing flat side of the movable blade 9.

This yields a passage slot 20 between the flat sides 11 and 21 of the fixed blade 5 and the fixed jaw 20 for the movable blade 9.

The width b of the passage slot 22 viewed in the direction of extension of the pivot axis x is essentially adjusted to the thickness d of the movable blade 9 penetrating through the passage slot 22 as viewed in the same direction, wherein the movable blade 9 further preferably has a constant thickness d.

Figure 5:
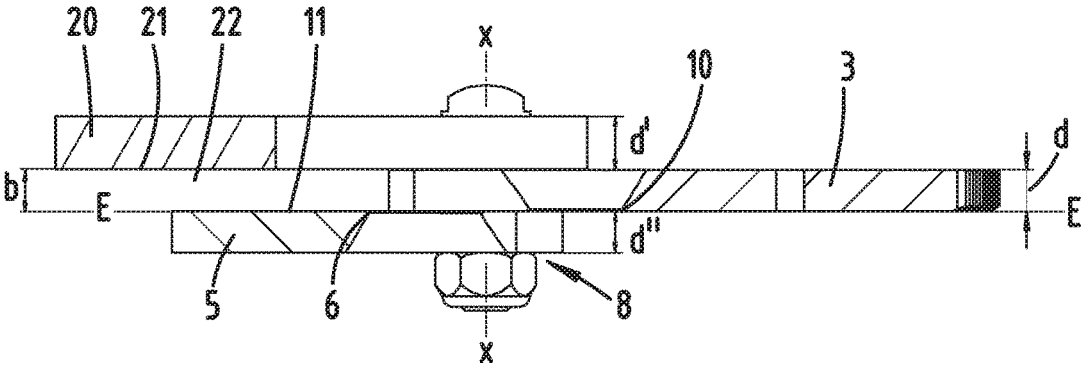
FIG. 5 The section according to line V-V on FIG. 2.

As also illustrated, the thickness d' of the jaw can further correspond to about 1.5 to 2 times the thickness d of the movable blade 9 and/or the thickness d" of the fixed blade 5 (see FIG. 5).

Figure 2:
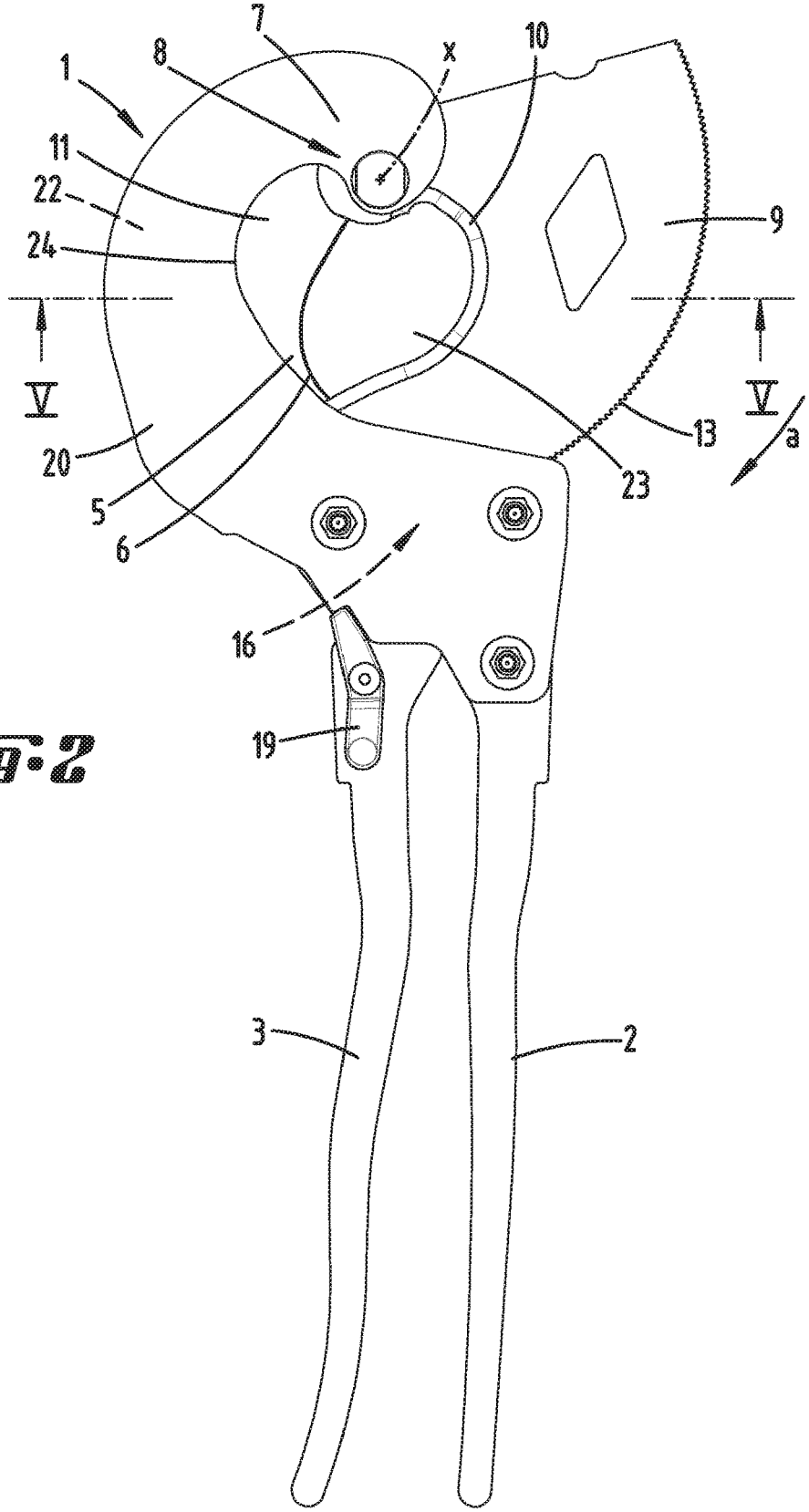
FIG. 2 The ratchet cutter in elevation view.
Figure 3:
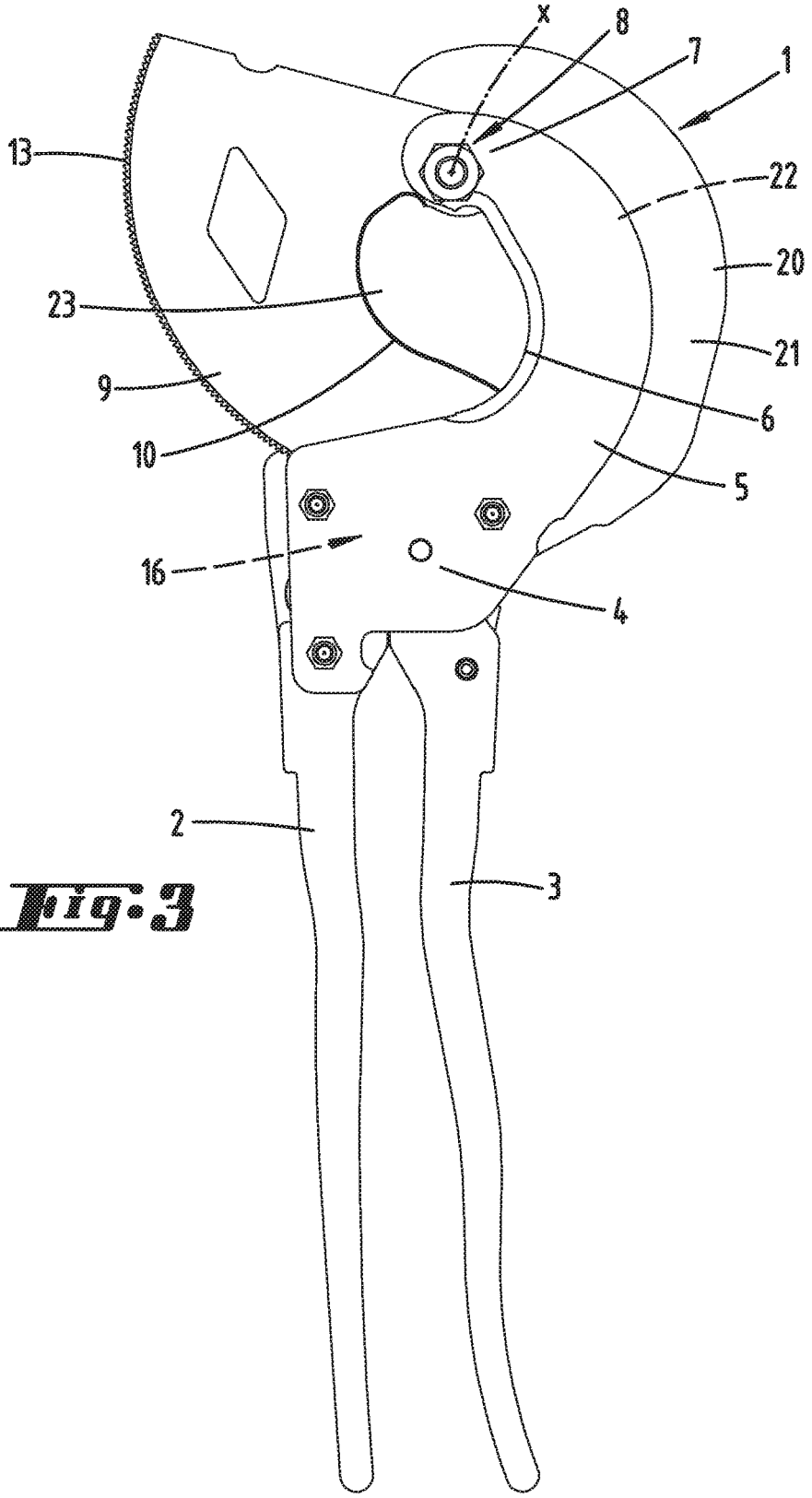
FIG. 3 A rear view of the ratchet cutter relative to the illustration on FIG. 2.
Figure 4:
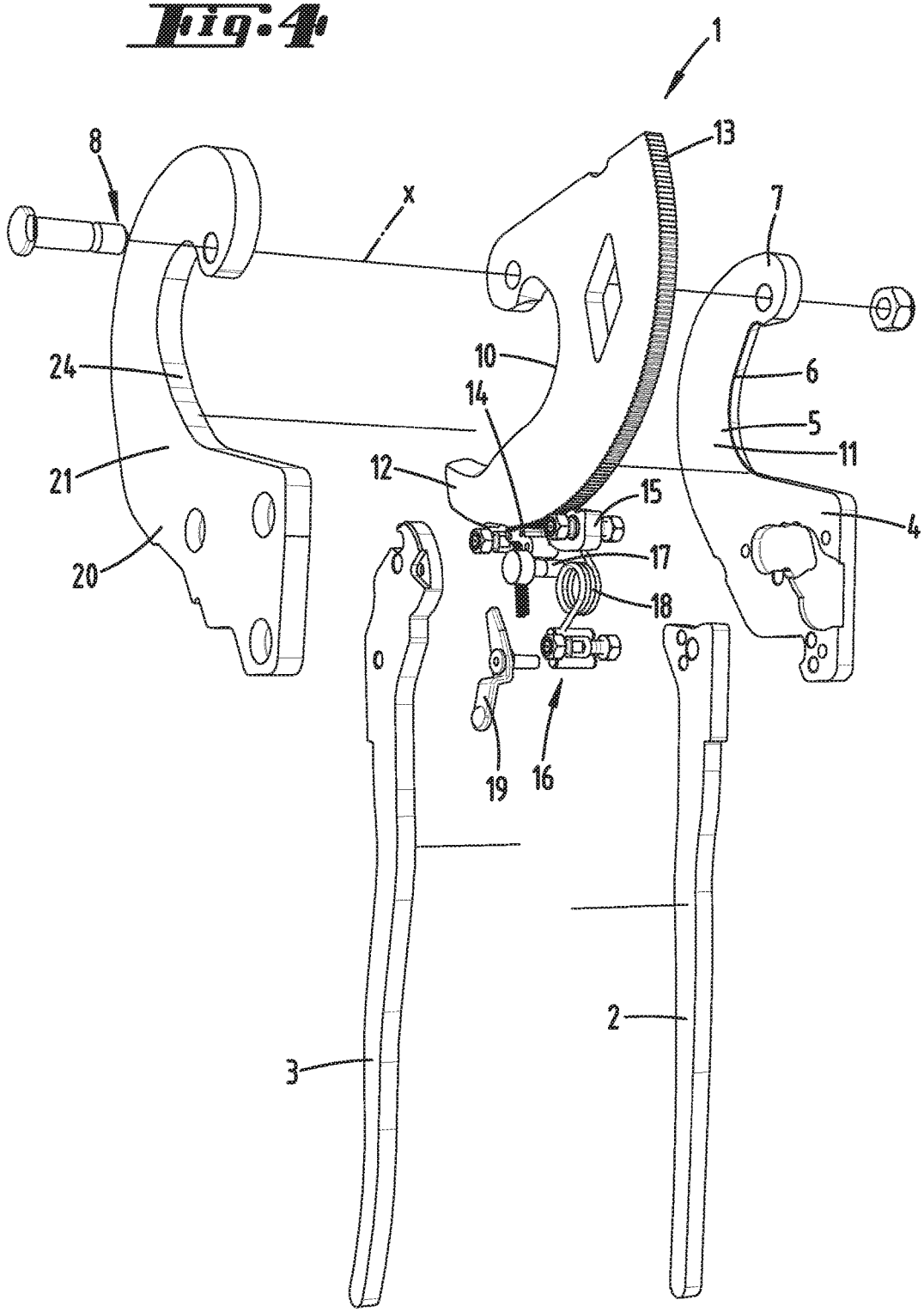
FIG. 4 A perspective, exploded view of the ratchet cutter.

Obtained in the pivoting direction a of the movable blade 9 during a cutting process with reference to a perpendicular projection toward the pivot axis x, for example as shown on FIG. 2, is a downstream arrangement of a supporting shoulder 24 of the fixed jaw 20 relative to the cutting edge of the fixed blade 5, said supporting shoulder being essentially aligned perpendicular to the cutting plane E and facing toward the cutting eye 23.

The arrangement is further selected in such a way that, in such a projection, the flat sections of the fixed blade 5 and fixed jaw lying one over the other in the direction of the pivot axis x form a shared projected overlapping surface U, in particular in the area of the passage slot 22, which tapers essentially proceeding from the bearing plate area, correspondingly proceeding from the area of the passage slot 22 initially passed through during the pivoting movement of the movable blade 9 toward the upper end area 7, essentially with a decreasing radius relative to the pivot axis x. According to the schematic illustration on FIG. 6, this yields an overlapping surface U that tapers like a sickle proceeding from the bearing plate 4 (see also tapering radius dimension r1 to r3 on FIG. 6).

During the sickle-like extension of the overlapping surface U, the radial extension (radius dimension r1 to r3) can in this way uniformly decrease.

Figure 6:
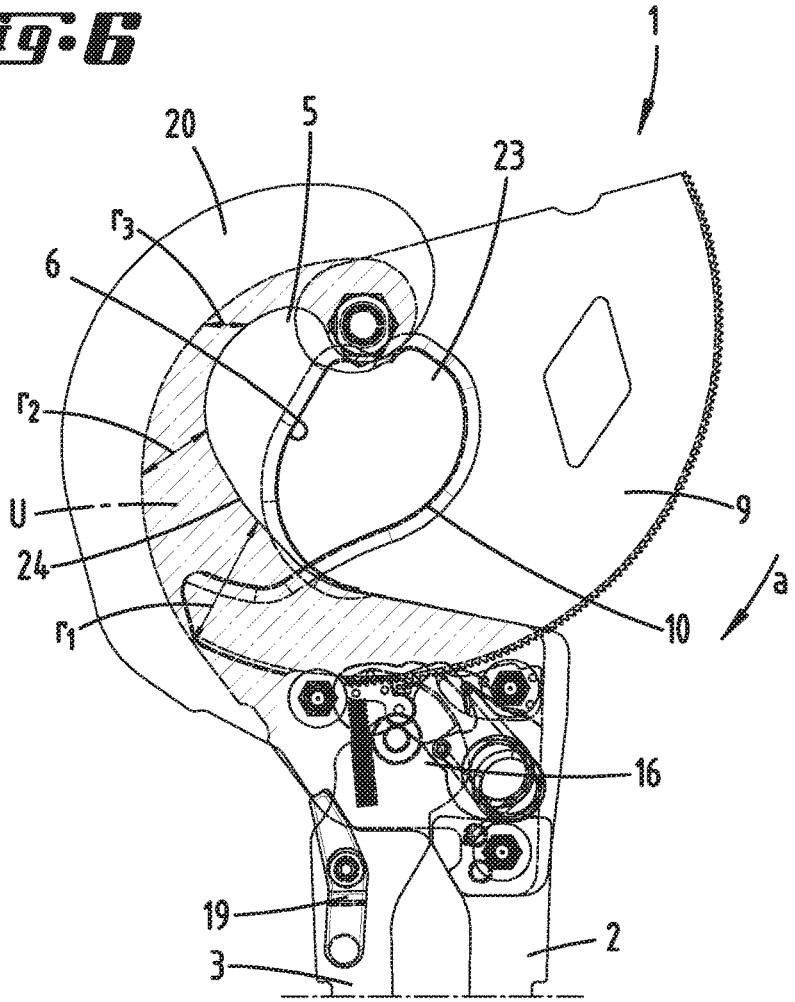
FIG. 6 A cutout from the elevation view according to FIG. 2, relating to a schematic illustration of an overlapping surface.

The overlapping surface U can run through a minimum near the upper end area 7 with respect to the radial extension, so as to thereafter once again run out into an enlarged overlapping area by comparison to the minimum in the area enveloping the pivot bearing 8 (see FIG. 6).

The above statements serve to explain the inventions encompassed by the invention overall, which further develop the prior art at least via the following feature combinations, each separately as well, wherein two, several or all of these feature combinations can also be combined, specifically:

A hand-operated ratchet cutter, characterized in that a passage slot 22 adjusted to the thickness d is formed between the first 11 and second 21 flat side, so that the jaw 20 acting as a supporting jaw ensures the shearing interaction between the movable 9 and fixed 5 blade, even under a load.

A hand-operated ratchet cutter, characterized in that only three parts perpendicular to the pivoting direction a of the movable blade 9 are provided one over the other in the thickness direction of the movable blade 9 in the area of the passage slot 22, including the movable blade 9.

A hand-operated ratchet cutter, characterized in that, given a perpendicular projection toward a pivot axis x of the movable blade 9, flat sections of the first and second flat sides 11, 21 located one over the other and, with the movable blade 9 passing completely through the passage slot 22 in the mentioned projection coming to overlap the movable blade 9, can initially decrease given a decreasing radius dimension of the movable blade 9.

A hand-operated ratchet cutter, characterized in that the thickness d' of the fixed jaw as viewed in the direction of the pivot axis x of the movable blade 9 in the area of the passage slot 22 corresponds to 1 to 2 times the thickness d" of the fixed blade 5 in the area of the passage slot 22 and/or 1 to 2 times the thickness d of the movable blade 9.

All disclosed features (taken separately but also in combination with each other) are essential to the invention. The disclosure of the application hereby incorporates in its entirety the disclosed content of the accompanying/attached priority documents (copy of preliminary application), also for the purpose of including features in these documents into claims of the present invention. The features in the subclaims characterize independent inventive further developments of prior art, in particular so as to initiate partial applications based upon these claims.

| Reference List | |
|---|---|
| 1 | Ratchet cutter |
| 2 | Fixed handle |
| 3 | Movable handle |
| 4 | Bearing plate |
| 5 | Fixed blade |
| 6 | Cutting edge |
| 7 | End area |
| 8 | Pivot bearing |
| 9 | Movable blade |
| 10 | Cutting edge |
| 11 | Flat side |
| 12 | End area |
| 13 | Tooth system |
| 14 | Feed lever |
| 15 | Locking lever |
| 16 | Ratchet mechanism |
| 17 | Trunnion pin |
| 18 | Spiral spring |
| 19 | Latching lever |
| 20 | Fixed jaw |
| 21 | Flat side |
| 22 | Passage slot |
| 23 | Cutting eye |
| 24 | Supporting shoulder |
| a | Pivoting direction |
| b | Width |
| d | Thickness |
| d' | Thickness |
| d" | Thickness |
| x | Pivot axis |

-continued

| Reference List | |
|---|---|
| E | Cutting plane |
| U | Overlapping surface |
| r1 | Radius dimension |
| r2 | Radius dimension |
| r3 | Radius dimension |

The invention claimed is:

1. A hand-operated ratchet cutter, comprising:

a movable handle having a movable blade with a constant thickness in its direction of movement, and a fixed handle that forms a first fixed blade with a first flat side facing the movable blade and a fixed jaw with a second flat side faxing the first flat side, the fixed jaw extending up to an upper end area of the first fixed blade and opposite to the first fixed blade relative to a cutting plane, wherein the movable blade is hinged to the upper end area of the fixed blade and is movable in a plane parallel to the cutting plane for shearing interaction in the cutting plane with the fixed blade, wherein a passage slot for the movable blade adjusted to the thickness of the movable blade is formed between the first flat side and the second flat side, so as to ensure the shearing interaction between the movable blade and the fixed blade even under a load, such that the fixed jaw acts as a supporting jaw, wherein the fixed jaw forms a supporting shoulder that is aligned perpendicular to the cutting plane and is arranged downstream of the cutting blade in a pivoting direction of the movable blade.

2. The hand-operated ratchet cutter according to claim 1, wherein only three parts lying one over the other perpendicular to the pivoting direction of the movable blade are provided in the area of the passage slot, including the movable blade, in a thickness direction of the movable blade.

3. The hand-operated ratchet cutter according to claim 1, wherein flat sections of the first and second flat sides are located one over the other and provide the passage slot for the movable blade, wherein the movable blade is configured to pass completely through the passage slot, and wherein an overlapping area of the flat sections has a decreasing dimension and tapers from a lower end of the fixed blade and fixed jaw toward the pivot axis.

4. The hand-operated ratchet cutter according to claim 1, wherein the thickness of the fixed jaw as viewed in the direction of the pivoting axis of the movable blade is 1 to 2 times the thickness of the fixed blade in the area of the passage slot and/or 1 to 2 times the thickness of the movable blade.

* * * * *